United States Patent [19]

Nickloy et al.

[11] Patent Number: 4,541,215

[45] Date of Patent: Sep. 17, 1985

[54] SNAP-IN CEILING SYSTEM

[75] Inventors: Charles H. Nickloy, Shawnee Mission; Thomas H. Plunkett, Overland Park, both of Kans.

[73] Assignee: Contour Packaging, Inc., Kansas City, Kans.

[21] Appl. No.: 512,723

[22] Filed: Jul. 11, 1983

Related U.S. Application Data

[63] Continuation-in-part of Ser. No. 369,276, Apr. 19, 1982, abandoned.

[51] Int. Cl.[4] ..... E04B 5/52; E04F 19/02

[52] U.S. Cl. ..... 52/479; 52/DIG. 8; 52/724; 52/725; 52/727

[58] Field of Search ..... 52/823, 479–481, 52/309.4, 309.6, 724, 725, 728, 727, DIG. 8; 248/345.1

[56] References Cited

U.S. PATENT DOCUMENTS

| | | | |
|---|---|---|---|
| 272,658 | 2/1883 | Cordes . | |
| 601,036 | 3/1898 | Camp . | |
| 646,192 | 3/1900 | Purdy . | |
| 1,857,369 | 5/1932 | Foster . | |
| 2,564,386 | 8/1951 | Webb | 248/345.1 |
| 3,416,282 | 12/1968 | Daugherty | 52/823 |
| 3,470,666 | 10/1969 | Mod et al. . | |
| 3,538,663 | 11/1970 | MacLeod . | |
| 3,903,671 | 9/1975 | Cuin et al. | 52/480 |
| 4,128,975 | 12/1978 | Abate | 52/309.4 |

FOREIGN PATENT DOCUMENTS

| | | |
|---|---|---|
| 648973 | 8/1964 | Belgium . |
| 1047188 | 7/1953 | France . |
| 554340 | 2/1942 | United Kingdom . |

*Primary Examiner*—James L. Ridgill, Jr.

*Attorney, Agent, or Firm*—Litman, Day and McMahon

[57] ABSTRACT

A ceiling assembly includes a plurality of elongate, side-by-side gripping members which easily fit onto and conceal the otherwise exposed lower portions of overhead floor joists, as in a basement. Appropriately sized elongate panels fit between the floor joists and have edges supported by the gripping members, thereby forming a smooth, finished appearing ceiling which is quickly and easily installed at low cost by a home resident. Extender members may be used to drop the gripping members a short distance below the joints to accommodate cross braces and plumbing lines.

7 Claims, 8 Drawing Figures

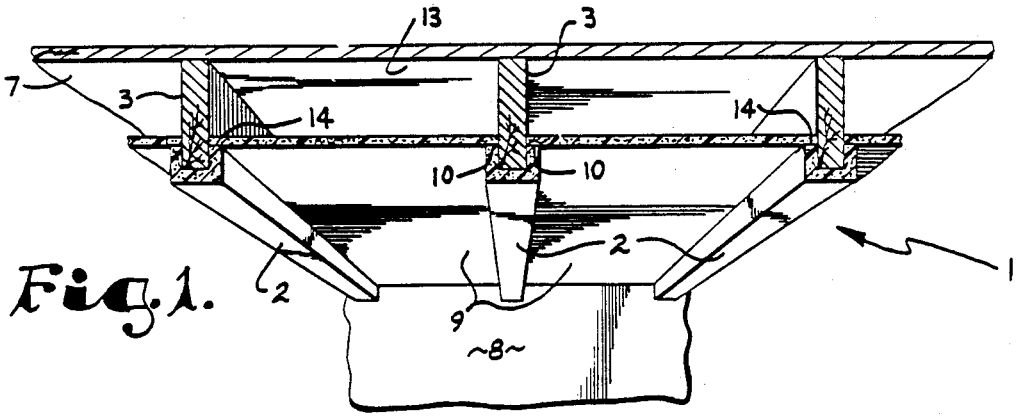
Fig. 1.
Fig. 2.
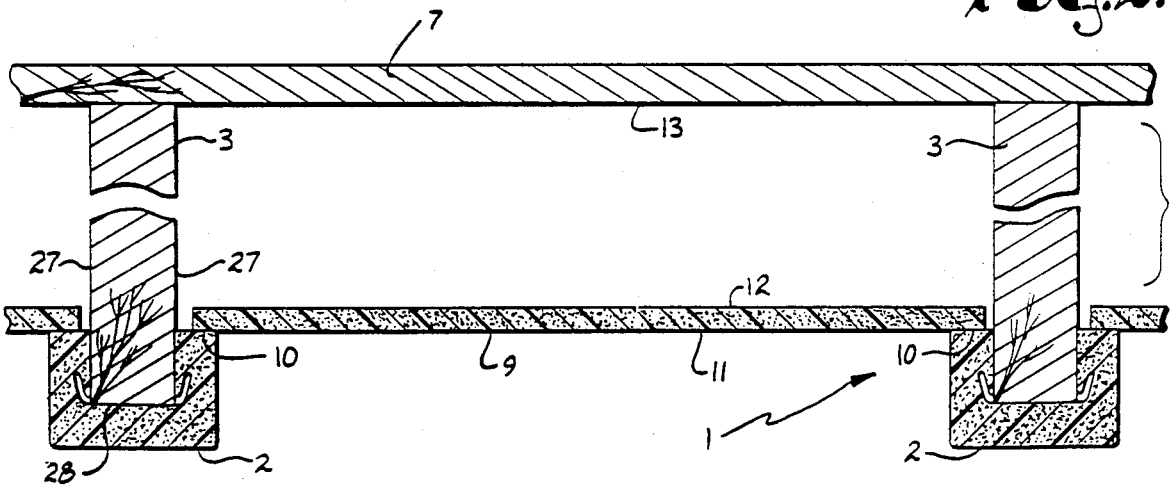
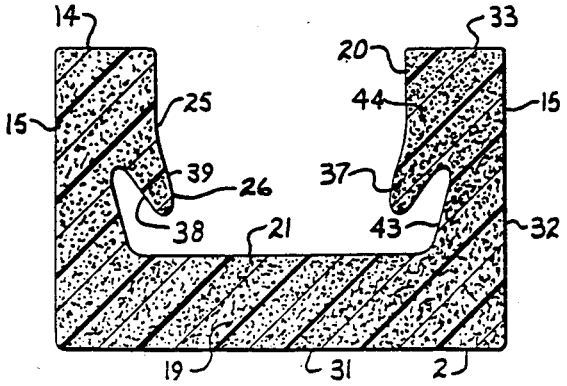
Fig. 3.
Fig. 4.
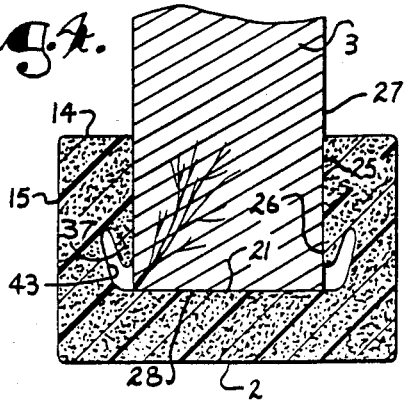

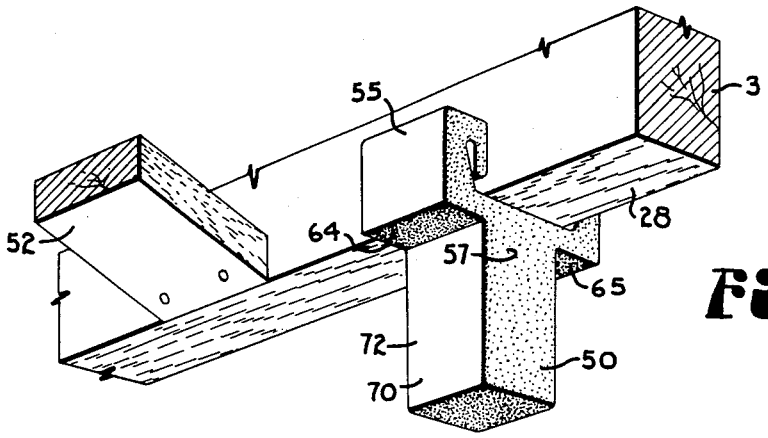
Fig. 5.
Fig. 6.
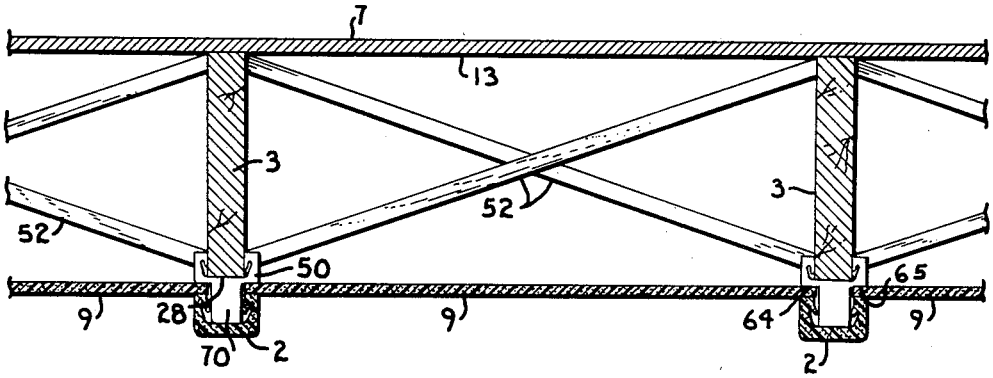
Fig. 7.
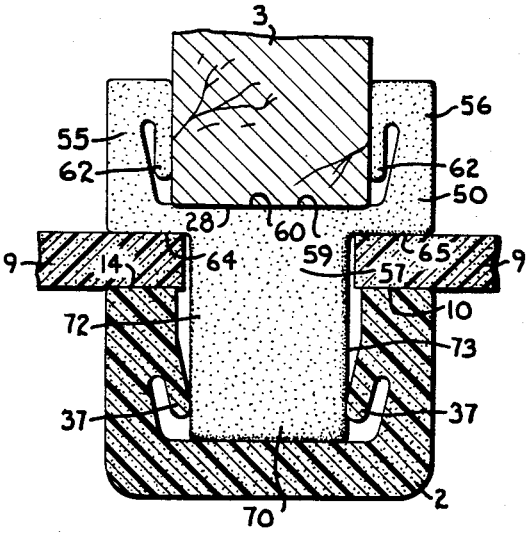
Fig. 8.
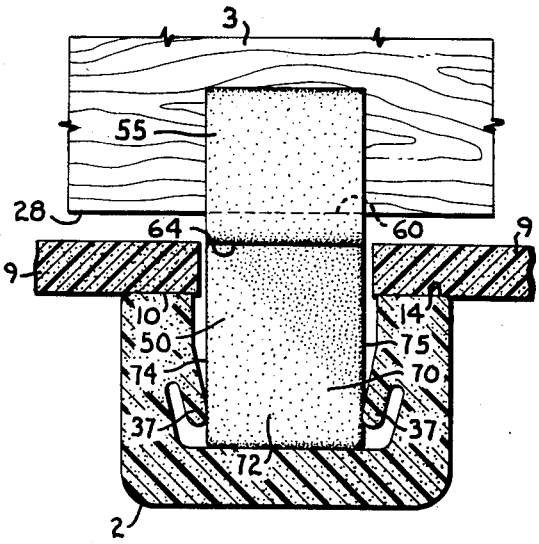

SNAP-IN CEILING SYSTEM

BACKGROUND OF THE INVENTION

This application is a continuation-in-part of application Ser. No. 369,276, filed Apr. 19, 1982 now abandoned.

This invention relates to ceiling assemblies and particularly such assemblies which utilize the structure above for support and have insertable panels.

Conventional ceiling assemblies using insertable panels commonly include a suspended grid depending from the span supporting structure of the floor above. Typically, this grid is of light-weight metal strips arranged to provide regularly sized rectangular openings. This grid ceiling usually depends from the span supporting structure of the floor above, such as joists, beams and the like through the use of numerous support wires or rods. Rectangular panels of proper size are placed in the grid to conceal an upper unfinished ceiling or even, as in the case of older, high ceiling buildings, to provide a lower, more temperature efficient ceiling.

In a typical wood construction residence, the floors are supported by wooden span supporting means or joists, which in the basement are typically exposed. If a conventional grid ceiling is suspended therefrom, sufficient length of the support wires or rods must be maintained to permit insertion of the panels angularly, so that they may fall into place on the grid. Thus, overhead space, which may and usually is at a premium in a basement, is taken up in the suspended ceiling grid system. Moreover, such a grid system often requires considerable installation time, since the metal grid pieces must be cut to suitable lengths and fastened into place, and at any irregularity in the outline of the ceiling, the panels must likewise be specially prepared. As well as considerable time, a variety of tools is required to complete this type of ceiling assembly, thereby placing this type of installation outside of the ability of the ordinary home owner.

Alternatively, the home owner may simply fasten wall board or plywood panels across the bottom of the exposed floor joists, as in the manner of conventional ceiling construction. This ordinarily results in a well finished appearing ceiling, however, when this type of ceiling is installed in an already low basement, the effect is to make the basement even lower and more cramped in appearance.

Many basements have ceiling heights of a little over seven feet, whereas the normal room height is eight feet. When the space between floor joists is left exposed, the basement height does not appear to be too short, however, when concealed to the level of the bottom of the joists in order to provide a finished ceiling, the reduction in height can be very noticeable and disconcerting.

Furthermore, construction of such a ceiling is often fairly laborious and requires the use of a number of tools, such as hammers, saws and measuring tools, as well as hardware, such as nails and sheet edge alignment clips.

OBJECTS OF THE INVENTION

The principal objects of the present invention are: to provide a ceiling assembly comprised of two types of structural elements; to provide such a ceiling assembly which requires no tools for its installation; to provide such a ceiling assembly which does not depend any significant distance from the floor above; to provide such a ceiling assembly having panels which fit upwardly into the space between floor joists; to provide such a ceiling assembly which requires little labor and time to install; to provide such a ceiling assembly having removable and replaceable panels; to provide such a ceiling assembly wherein one member is capable of directly engaging a floor joist and of supporting a side of a panel; and to provide such a ceiling assembly which is relatively inexpensive, effective and aesthetic in use, and well adapted for its intended purpose.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 1 is a fragmentary, perspective view of a ceiling assembly embodying the present invention.

FIG. 2 is an enlarged, elevational fragmentary end view.

FIG. 3 is an enlarged, elevational view of a gripping member.

FIG. 4 is an enlarged, elevational view showing the connection between a gripping member and a joist.

FIG. 5 is a fragmentary, perspective view of an assembly using an extender member.

FIG. 6 is a cross-sectional view of the assembly with extender members.

FIG. 7 is an enlarged cross-sectional view of the extender member in one orientation.

FIG. 8 is a cross-sectional view of the extender member in a second orientation.

DETAILED DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1, FIG. 1, generally indicates a ceiling assembly embodying the present invention and having a plurality of side-by-side channular gripping members 2 retainably engaging joists 3 which constitute the span supporting elements of a floor 7 in a structure 8.

Generally, the floor 7 is of wooden free span construction having a plurality of the downwardly exposed joists 3 acting as the span supporting elements. The joists 3 are generally arranged thereunder in a parallel and evenly spaced manner, such spacing being, for example, a center-to-center distance of 16 inches. Furthermore, the joists 3 are normally of rectangular cross-section, known in the art as 2×6 or 2×8 beams, and are oriented with the larger dimension vertical.

Panels 9 fit within the transverse openings 13 between adjacent joists 3 and have opposite edges 10 resting on support means, such as lips 14 on respective spaced gripping members 2, thereby providing a finished appearing ceiling assembly 1 which conceals the normally exposed joists 3 and floor 7 underside.

The gripping member 2 and the panels 9 are preferably fabricated of a plastic synthetic material, such as expanded bead polystyrene or Styrofoam, a trademark of the Dow Chemical Company, which is lightweight and easily formed and has a smooth finish permitting applying paint or adhesive coverings. Also, such a material as expanded bead polystyrene possesses desirable sound deadening qualities. Preferably, the material used has a resilience or memory so that it tends to return to and retain a given shape.

In the illustrated example, the finished ceiling assembly 1, FIG. 1, has the plurality of side-by-side channular gripping members 2 and the plurality of panels 9 supported by the joists 3. Each gripping member 2 is preferably elongate and generally in the shape of a beam. Commensurately, the panels 9 are preferably elongate, rectangular and relatively flat bodies of thin cross-section. The panels 9 respectively have opposite side edges 10 and upper and lower surfaces 11 and 12. The length of the panels 9 are preferably the same as the length of the gripping members 2 in order to permit easier packaging of the system, and the width thereof appropriately sized to fit horizontally into and conceal the transverse opening 13 between the joists 3 as shown in FIGS. 1 and 2.

The exemplary gripping member 2, FIG. 3, has spaced, upwardly extending arms 15 joined by a web 19. The arms 15 are spaced or sized to tightly grip the narrow dimension of the joist 3. The configuration of the arms 15 and web 19 forms a channel 20 of generally U-shaped cross-section having a flat web interior surface 21 and arm interior surfaces 25. A plurality of protuberances 26 for engaging the sides 27 of the joist 3 extend into the channel 20 from the arm interior surfaces 25, where each joist 3 has a planar bottom surface 28 joining spaced planar side surfaces 27.

The gripping member 2 further has an exterior planar bottom surface 31 parallel to the web interior surface 21 and planar exterior arm surfaces 32 perpendicular thereto, such that a generally rectangular outline is given to the gripping member 2. Associated with each upwardly extending arm 15 is the support means capable of engaging and supporting the edge 10 of the panel 9. In the illustrated example, the support means is the lip 14 formed by the planar top surface 33 of each upwardly extending arm 15.

The protuberance 26, FIG. 3, extending from each arm interior surface 25 is a wedge-shaped tooth 37 angling downwardly and protruding into the channel 20. Each tooth 37 has a recess side 38 and an engagement side 39. A recess 43 is provided between the tooth recess side 38 and extends upwardly into the arm interior surface 25 and is sized for accepting a partial retraction of the tooth 37 upon insertion of the joist 3 into the channel 20. The recess 43 is a wedge-shaped cavity extending angularly upwardly, into the upwardly extending arm 15 adjacent to the tooth 37 and to the depth of the tooth root 44. Each tooth 37 and its accompanying recess 43 extend longitudinally the length of the gripping member 2. During mutual engagement of the gripping member 2 with the joist 3, each tooth 37 at least partially retracts into its accompanying recess 43. This retraction causes tension to be applied along the tooth engagement side 39 and thus permits relatively easy engagement, or fitting on, of the gripping member 2 with the joist 3 while causing compression to be applied at the tooth root 44, such that removal or disengagement is relatively difficult. This upward compression of the tooth 37 against the tooth root 44 is a result of the downward weight of the gripping member 2 and any panels 9 supported thereby.

When the gripping member 2 is fully mounted onto the joist 3, face-to-face contact exists between the web interior surface 21 and the joist bottom 28 along the length of the gripping member 2. Such face-to-face contact occurs between the tooth engagement side 39 and the lower portion of the adjacent joist side 27, as well as between the arm interior surface 25 and the lower portion of the joist side 27, both for the length of the gripping member 2.

FIGS. 5 through 8 illustrate the member 50 used to drop the ceiling assembly 1 to a somewhat lower level below the bottom 28 of the joist 3 when obstructions are encountered. Such obstructions can be water lines, electrical conduits or, as shown in the illustrated example, FIGS. 5 and 6, cross braces 52.

The extender member 50 generally has the same cross-sectional configuration as said gripping member 2 with the exception that it also includes a downwardly projecting tongue which is received by the underlying gripping member 2. The extender member 50 has spaced upwardly extending arms 55 and 56 joined by a web 57. The arms 55 and 56 are sized or dimensioned to tightly grip the narrow dimension of the joist 3. The configuration of the arms 55 and 56 forms a channel 59 of generally U-shaped cross section having a flat web interior surface 60. A plurality of protruberances 62 for engaging the sides of the joists 3 extend into the channel 59 from the opposite interior surfaces of the arms 55 and 56. The extender member 50 has opposite downwardly facing surfaces 64 and 65 which are preferably horizontally aligned and abut the upper side edge of the panel 9 when assembled.

A tongue 70 forms a downwardly extending part of the extender member 50 and provides the necessary vertical drop to clear obstacles. The tongue 70 has opposites flange side surfaces 72 and 73, FIG. 7 and opposite flat end surfaces 74 and 75, FIG. 8. The dimensions of each of the surfaces 72 through 75 are preferably equal, or cut to be equal during assembly, so that the extender member 50 can be used in either of the orientations depicted in FIGS. 7 and 8. Accordingly, the longitudinal dimension of the panels 9 can extend longitudinally or transversely relative to the joists 3. The gripping members 2 are slipped onto the tongue either longitudinally or transverse to the joists 3. And in either orientation, the teeth 37 engage and grip the surfaces 72 and 73 or 74 and 75. In the orientation shown in FIG. 7, the gripping members 2 extend longitudinally to the joist 3 whereas in FIG. 8, the gripping member 2 extends transversely to the joists 3. Assembly is accomplished by first attaching the extender member 50 to the joist and then affixing the gripping member 2 in the desired orientation. The edges of the panel 9 are laid atop the end of a lip 14.

In use, the ceiling assembly 1 is constructed by fitting the plurality of gripping members 2 respectively onto the bottom portions of each of a plurality of joists 3, thereby concealing the bottom portions from view. The transverse openings 13 between each of the joists 3 are then covered by inclining upwardly one side edge 10 of each panel 9 and moving the panel 9 upwardly into the transverse opening 13 to a point above the gripping members 2 on each joist 3, and then leveling the panel 9 horizontally and lowering it into supporting engagement on the lips 14 of the gripping members 2. When this process is completed for each transverse opening 13, every joist 3 and the floor 7 thereabove is concealed from view by the ceiling assembly 1. Panels 9 could be removed by the reverse of the above procedure if damaged or if inspection of the floor 7 should become necessary. Furthermore, while the disengagement force required to remove a gripping member 2 from a joist 3 is greater than the force required to fit the gripping member 2 onto the joist 3, only hand pressure is required; and therefore, no tools are required to install or remove the entire ceiling assembly 1.

It is to be understood that while certain forms of the present invention have been illustrated and described herein, it is not to be limited to the specific forms or arrangement of parts described and shown.

What is claimed and desired to be secured by Letters Patent is:

1. A ceiling assembly for providing a permanent ceiling with replaceable parts thereof utilizing the lower portions of a plurality of downwardly exposed smooth faced, rectangular floor joists acting as the span elements in a floor and providing transverse openings therebetween and comprised of:

(a) a gripping member having a relatively elongated body of generally rectangular outline with a planar bottom surface and planar sides perpendicular thereto; said gripping member further having a channel in the top thereof such that said gripping member has a cross-section of U-shape; said channel having spaced upwardly extending arms thereon joined by a web extending therebetween; said web being sized to cause said arms to snugly engage the sides of a wooden floor joist having a planar bottom and spaced planar sides, and said web further having a planar interior surface adapted to engage said planar bottom of said joist; said arms having a supporting lip portion associated therewith; each said lip being the planar top of said arm; said gripping member fabricated of a resilient plastic foam material having a resilient bias causing said gripping member to engage said joist; said material being stronger in compression than in tension;

(b) each said arm having on the arm interior surface thereof a wedge-shaped tooth protruding downwardly and angularly into said channel; a portion of said tooth and a portion of said arm interior surface forming a recess therebetween such that upon insertion of said joist, partial retraction of said tooth into said recess occurs and places said tooth in tension upon engagement of said gripping member to said joist; whereas upward compression of said tooth is caused by downward loads on said gripping member such that a greater disengagement force is required than for said engagement; each said tooth and its accompanying recess extending longitudinally the length of said gripping member; and (c) a panel fabricated of a plastic material; said panel being an elongated rectangular body of substantially the same length as said gripping member and adapted to fit concealingly into the transverse opening between adjacent said joists; said panel having opposite side edges for engagement upon and support by said lip portions whereby a plurality of said gripping members engaging a plurality of said joists are capable of supportingly engaging a plurality of said panels in said transverse opening between said joists such that a ceiling assembly is formed.

2. A ceiling assembly as set forth in claim 1 wherein:

(a) said plastic material is an expanded bead polystyrene.

3. A ceiling assembly for providing a permanent ceiling with replaceable parts thereof utilizing the lower portions of a plurality of downwardly exposed smooth faced, rectangular floor joists acting as the span elements in a floor and providing transverse openings therebetween and comprised of:

(a) a gripping member of elongate form and having a joist receiving channel and spaced, upwardly extending arms with a web extending therebetween and forming a generally U-shaped cross-section; said web being sized to cause said arms to snugly engage the sides of the joist and the web engaging the bottom of the joist; and arms having a supporting lip portion; said gripping member being formed of a resilient synthetic plastic foam material having a resilient bias causing said gripping member to engage said joist;

(b) each of said arms having an interior surface with a tooth thereon protruding angularly and downwardly into said channel, said tooth being compressible relative to said gripping member to tightly engage the sides of said joist and hold said gripping member thereon; and (c) panels having opposite side edges each for engagement with said gripping member whereby a plurality of said gripping members engaging a plurality of said joists are capable of supportingly engaging a plurality of said panels in said transverse opening between said joists such that a ceiling assembly is formed.

4. The ceiling assembly set forth in claim 3 wherein:

(a) said joist has a planar bottom surface and spaced, lower side surfaces;

(b) said web has substantially planar parallel inner and outer surfaces and said inner surface is engageable with said bottom surface of said joist;

(c) said arms have inner and outer surfaces; said inner surfaces having thereon a plurality of said compressible teeth extending into said channel for engagement with said side surfaces of said joist.

5. The ceiling assembly set forth in claim 3 wherein:

(a) a portion of said tooth and a portion of said inner wall defining a recess therebetween commensurately sized with said tooth whereupon compression of said tooth, said tooth partially retracts into said recess;

(b) each said tooth being wedge-shaped and extending longitudinally the length of said channel; and (c) said recess being a wedge-shaped cavity extending upwardly into said arm and extending longitudinally the length of said channel.

6. The ceiling assembly set forth in claim 3 including:

(a) an extender member for interposing between said floor joist and at least one of said gripping members;

(b) each said extender member having spaced, upwardly extending arms defining a channel sized for fitting snugly about the exposed lower portions of said floor joist, and a downwardly extending tongue for fitting into the channel of said one of said gripping members.

7. The ceiling assembly set forth in claim 6 wherein:

(a) said arms of said extender member have inner and outer surfaces; said inner surfaces having a plurality of teeth extending into said channel for engagement with said side surfaces of said joist.

* * * * *